US008021288B2

(12) United States Patent
Ferrara

(10) Patent No.: US 8,021,288 B2
(45) Date of Patent: Sep. 20, 2011

(54) DEVICE FOR MOVING PEOPLE OR OBJECTS IN A FLEXIBLE CONTROLLABLE MANNER

(76) Inventor: Paolo Ferrara, Kematen an der Krems (AT)

( * ) Notice: Subject to any disclaimer, the term of this patent is extended or adjusted under 35 U.S.C. 154(b) by 540 days.

(21) Appl. No.: 12/088,483

(22) PCT Filed: Sep. 28, 2006

(86) PCT No.: PCT/AT2006/000394

§ 371 (c)(1),
(2), (4) Date: Mar. 28, 2008

(87) PCT Pub. No.: WO2007/035976

PCT Pub. Date: Apr. 5, 2007

(65) Prior Publication Data

US 2008/0254958 A1 Oct. 16, 2008

(30) Foreign Application Priority Data

Sep. 30, 2005 (AT) ..... A 1608/2005
Sep. 6, 2006 (AT) ..... A 1482/2006

(51) Int. Cl.
*A63B 26/00* (2006.01)

(52) U.S. Cl. ..... 482/142

(58) Field of Classification Search ..... 223/43; 431/145; 19/109; 15/300.1, 401; 279/401; 222/195; 221/278; 209/906; 56/30, 13.1, 56/12.9; 305/34; 5/706; 227/9; 84/24, 331; 446/176; 400/176, 182; 297/199; 152/1
See application file for complete search history.

(56) References Cited

U.S. PATENT DOCUMENTS

| | | | | |
|---|---|---|---|---|
| 4,615,260 | A | 10/1986 | Takagi | |
| 5,112,045 | A | 5/1992 | Mason et al. | |
| 5,629,594 | A | 5/1997 | Jacobus et al. | |
| 6,624,802 | B1 | 9/2003 | Klein et al. | |
| 6,796,918 | B1 | 9/2004 | Cinquin et al. | |
| 7,004,895 | B2 * | 2/2006 | Perry et al. | 482/146 |
| 7,299,741 | B2 | 11/2007 | Hiramatsu et al. | |
| 2003/0199374 | A1 | 10/2003 | Perry et al. | |
| 2004/0267331 | A1 | 12/2004 | Koeneman et al. | |

FOREIGN PATENT DOCUMENTS

| | | | |
|---|---|---|---|
| AT | 411015 | B | 2/2003 |
| DE | 3630822 | A1 | 3/1987 |
| DE | 19709456 | A1 | 9/1998 |
| DE | 19846337 | C1 | 3/2000 |
| DE | 19912281 | A1 | 10/2000 |
| DE | 10004785 | A1 | 8/2001 |
| EP | 0261721 | A2 | 3/1988 |
| GB | 971556 | | 9/1964 |
| GB | 1331756 | | 9/1973 |
| WO | WO2004085856 | A1 | 10/2004 |
| WO | 2004096112 | A1 | 11/2004 |
| WO | WO 2004096112 | A1 * | 11/2004 |

* cited by examiner

*Primary Examiner* — Lori Baker
(74) *Attorney, Agent, or Firm* — Muirhead and Saturnelli, LLC

(57) ABSTRACT

The invention relates to a device for moving people or objects for the purposes of play, sport, pedagogy or therapy. Said device consists of a static base surface (2), a mobile surface (1) on which the person to be moved is located, and active, controllable, mechanical adjusting bodies which act between the static and mobile surfaces. Piston-free pneumatic actuators (3) are used for the mechanical adjusting bodies. In this way, the device is essentially more economical, smaller, lighter and more reliable than known comparable devices comprising different active mechanical adjusting bodies.

26 Claims, 5 Drawing Sheets

DEVICE FOR MOVING PEOPLE OR OBJECTS IN A FLEXIBLE CONTROLLABLE MANNER

TECHNICAL FIELD

The invention relates to a device for moving people or objects in a flexible controllable manner. Applications include, for example, moving people for the purposes of play, sport, pedagogy or therapy, moving structural parts for the purposes of testing, and moving receptacles for the purposes of mixing liquid and/or powdery substances arranged in them.

BACKGROUND OF THE INVENTION

There are various types of relatively simple rockers or seesaw devices which are typically set up in the practices of physiotherapists, sometimes also in fitness centers, and on which persons place themselves in order to perform exercises. For examples of such devices, reference may be made to AT 411 015 B and to DE 100 04 785 B4.

According to AT 411 015 B, the person exercising stands on a platform that rests on the ground via two rockers that are curved in a vertical plane, such that the platform can seesaw via these rockers. The position of the rockers can be adjusted so as to make the rocking movement of the platform gentler or more abrupt. The person standing on the platform is stimulated to balance himself in such a way that the platform remains horizontal.

An advantage of this device is that it is simple, inexpensive and takes up little space. A disadvantage is that it permits only one degree of freedom of movement, namely a rocking movement in a vertical plane. A further disadvantage is that the characteristic curve of the rocking movement cannot be adjusted during operation of the device.

DE 100 04 785 B4 discloses a stand surface that can be swiveled within a limited angle range about two horizontal axles which are located at a distance above it and are perpendicular to each other. Movement of the platform can be subjected to a mechanical attenuation. The height of the axles above the stand surface and the movement attenuation are adjustable. The angular excursion can be visualized for the user.

This device too is relatively simple and also still inexpensive. Compared to the aforementioned device, it offers a further degree of freedom of movement and adjustable attenuation. A disadvantage is that it takes up quite a lot of space and that it places only minimal demands on the sense of balance.

There are additionally devices which, in cooperation with computers and active drive elements, can move surfaces on which a person is located in up to all six degrees of freedom and which additionally show corresponding images on screens, for example of journeys in virtual space, or informative displays on movement states. Movement and images can optionally be influenced interactively by the person using the installation, or they simply run in the manner of a film and thus exert their action on the person. Such devices are, for example, vehicle simulators used for training purposes. In a somewhat more economical form, they are also used as still very expensive games devices with which, for example in gaming halls or at funfairs, a so-called "virtual reality" can be experienced for a few minutes against payment of a fee.

For examples of such devices, reference may be made to U.S. Pat. No. 5,629,594, DE 199 12 281 A1 and DE 198 46 337 C2.

U.S. Pat. No. 5,629,594 discloses a device which, in connection with a computer, can displace a surface, on which a person is located, in an accelerated movement within a limited range, and can thus ensure that movements which take place in the reality simulated in the computer can be made appreciable in the actual reality of the computer user. The movement is effected by means of electric motors, toothed wheels and toothed racks. This is extremely expensive. In addition, the dynamically controlled electric motors require frequency converters, which cause considerable problems in normal power supply networks.

DE 199 12 281 A1 discloses a riding simulator which can move a dummy horse in three linear directions and in three rotation directions. The movement is effected by means of pneumatic cylinders. Because of the static friction between cylinder and piston, coupled with the elasticity of volume of gases, it is practically impossible to simulate fine movements with alternating directions without causing jolts. On the whole, it is only by using very expensive mechanical components and an extremely intelligent and highly dynamic control system that the arrangement can be produced in approximately the quality specified in the document. The installation is therefore very expensive.

If the construction according to DE 199 12 281 A1 were to be realized with hydraulic drive elements instead of pneumatic elements, the problem of the elasticity of volume of the pressure medium could be avoided. However, a hydraulic installation is also associated with high costs, considerable weight, in some cases unpleasant smells, and, in the event of leaks, the risk of contamination.

According to both U.S. Pat. No. 5,629,594 and DE 199 12 281 A1, constructions are proposed in which, on a base slide movable in one direction, a further slide is mounted which is movable thereon in another direction, etc. until on the last slide the mobile surface is secured. This construction has the effect that the kinematic relationships are at all times easy to understand, but it is very heavy and expensive.

By contrast, DE 198 46 337 C2 discloses a construction according to which the mobile surface is held at three points rotatably on one end of length-adaptable adjusting elements. With the other end, the adjusting elements are also secured rotatably on a stationary base surface. All movements of the mobile surface are effected by suitably coordinated changing of the length of the adjusting elements. Compared to a construction with stacked slides, this construction is much less expensive, even if it requires slightly more computer performance. However, this results in a very bulky structure which, in the assembled state, can be transported only with great difficulty.

The length-adaptable adjusting elements according to DE 198 46 337 C2 are not described in detail in the document. From the drawing and arrangement, however, it is evident that they are pneumatic or hydraulic cylinder/piston arrangements. With these, the problems already mentioned above also arise.

SUMMARY OF THE INVENTION

Starting out from this prior art, the inventor has set himself the object of making available a device for moving people or other objects which itself stands at one site and has a moved surface on which the person or the object is located. The movement range is intended to lie in the order of magnitude of centimeters to decimeters, and the frequency range in periodic movements is intended at small amplitudes to reach up to a few Hertz. The device is intended to be able to run actively through different predefinable movement patterns in several degrees of freedom of the movement. It is intended to afford the possibility of controlling the movement patterns by a computer, and it should afford the possibility of measuring the respective state of movement and further processing the measured result by computer technology.

Compared to known devices already available for this purpose, the novel device is intended to be much less expensive. In addition, it should be possible to design it such that (in the assembled state) it requires less room, and such that it weighs very much less than the weight that it can properly move. This is an important requirement for possible use as a home therapy device.

According to the invention, piston-free pneumatic actuators are used as active, controllable, length-adaptable adjusting elements which act between fixed and moved part of the device.

Piston-free pneumatic actuators" are in this sense understood as actuators which are composed of a tubular flexible middle part and of two rigid, panel-like or sleeve-like end pieces, of which at least one is provided with an air passage. The tubular middle part is composed of an airtight jacket surface in which are incorporated elements, for example in the form of nets, straps or wires, which barely expand upon tensile stress. Depending on how these tension-resistant elements are oriented, there are piston-free pneumatic actuators which when inflated shorten (e.g. GB 1331756 Trish Energetics, published 1973), that is to say apply a traction force outwardly, or lengthen, that is to say apply a pressing force outwardly. Piston-free pneumatic actuators that apply a traction force outwardly are also designated as "air muscle". Piston-free pneumatic actuators that apply a pressing force outwardly are often designated as bellows cylinders.

These piston-free pneumatic actuators have no static friction.

Since piston-free pneumatic actuators, in their longitudinal direction, can in each case only exert a force in one direction, that is to say either only a traction force or only a pressing force, either two oppositely acting actuators of this type are used, or a combination of a piston-free pneumatic actuator and an oppositely acting pretensioned elastic spring is used.

To save space, the pulling piston-free pneumatic actuators of a device, which are relatively long in relation to their working stroke, are if possible designed such that their longitudinal direction lies parallel to the base plane of the device. The line of application of these piston-free pneumatic actuators is if necessary guided by means of transmissions, for example with cables and guide rollers.

BRIEF DESCRIPTION OF THE DRAWINGS

The invention will become clearer from the drawings, which show schematic diagrams of illustrative embodiments and in which.

DETAILED DESCRIPTION OF VARIOUS EMBODIMENTS

Figure 1:
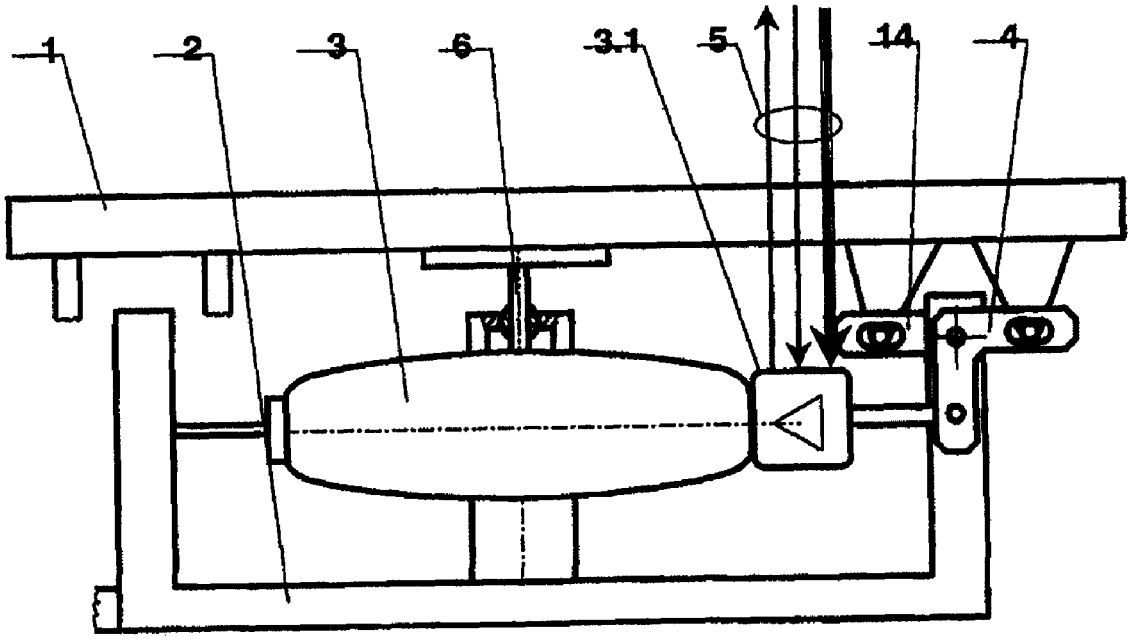
FIG. 1 shows a side view of a device according to the invention. The view is restricted to the structural elements essential to the understanding of the invention. Pulling piston-free pneumatic actuators serve exclusively as active, controllable, length-adaptable adjusting elements. The force transmission from the piston-free pneumatic actuators to the mobile surface is effected by means of pivot levers.

According to the example shown in FIG. 1, the surface 1 (or mobile surface 1) to be moved relative to the base 2 can be moved vertically up and down by contraction of the pulling piston-free pneumatic actuators 3 via pivot levers 4, 14 at the respective points of application. The piston-free pneumatic actuators 3 are connected to lines 5. Here, one line is a tube for delivering air from a compressor into the piston-free pneumatic actuators.

Another line conveys electrical signals from a control unit to the controllable valve 3.1, which accordingly allows air to flow into the actuators or allows air to flow from the actuator to the outside or seals everything. A third line conveys electronic measurement data relating to the length of the actuator and to gas pressure in the actuators, and possibly also relating to the force acting on the control unit.

Piston-free pneumatic actuators, which are equipped with the corresponding sensors for length, pressure and force, are nowadays serial products that are obtainable in standardized quality.

If the surface 1 according to FIG. 1 is equipped at three mutually remote locations with such points of application for the vertical movement, the surface can be moved in two degrees of freedom of rotation (about horizontal axes) and linearly in the vertical direction. In order to avoid undefined further movement components, the device can be provided with a guide mechanism 6, which forms an abutment against such movements.

Figure 2:
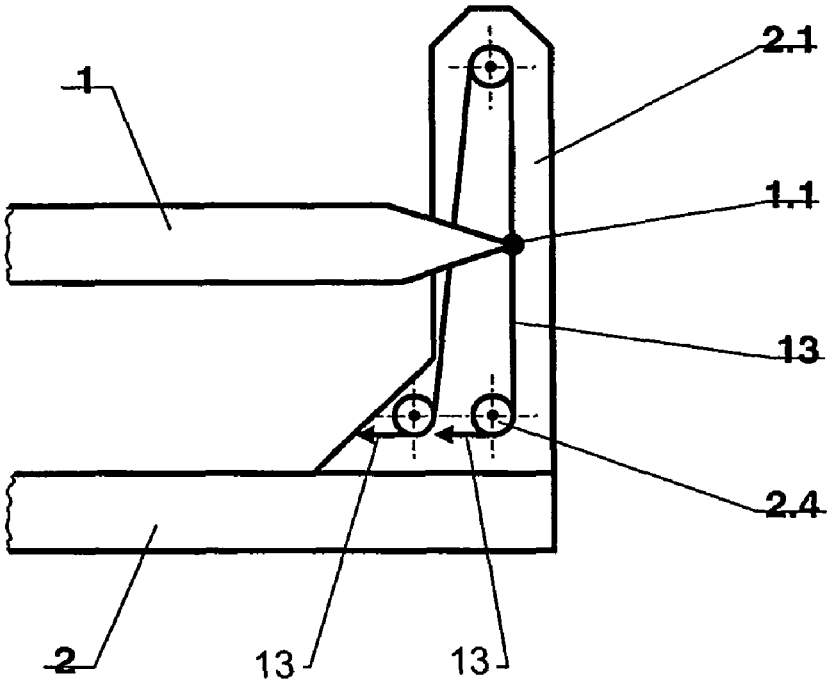
FIG. 2 shows a side view of important elements of another device according to the invention, in which, once again, only pulling piston-free pneumatic actuators are used as active, controllable, length-adaptable adjusting elements. The force transmission from the piston-free pneumatic actuators to the mobile surface is effected by means of cables and guide rollers.

According to the example shown in FIG. 2, the surface 1 to be moved relative to the base 2 can be moved vertically up and down by contraction of the pulling piston-free pneumatic actuators 3 via a cable 13 and guide rollers 2.4 at the respective points of application. Compared to the construction in FIG. 1, the flexibility of the cable thus means less effort for the angle-flexible securing of the surface 1 to the respective force transmission parts, which is required for the pivoting movement. To ensure that the surface 1 can also be moved upward, a cable section has to extend upward from the force application point 1.1. It is therefore necessary for a guide roller 2.4 to be arranged above the surface 1, on an extension piece 2.1 of the base 2 protruding upward above the surface 1. To ensure that the piston-free pneumatic actuators acting on this cable section can be located under the mobile surface 1 and be oriented parallel thereto, a further cable roller is needed via which the cable is guided into the correct direction at the correct place. It would also be possible for the actuator pulling the surface 1 upward to be arranged above the surface 1; if it is intended to be oriented parallel to the surface 1, then only one cable roller is needed. If it is to be oriented vertically, no cable roller is needed at all; the upwardly protruding extension piece 2.1, and with it the entire device, would then be considerably higher, however.

Figure 3:
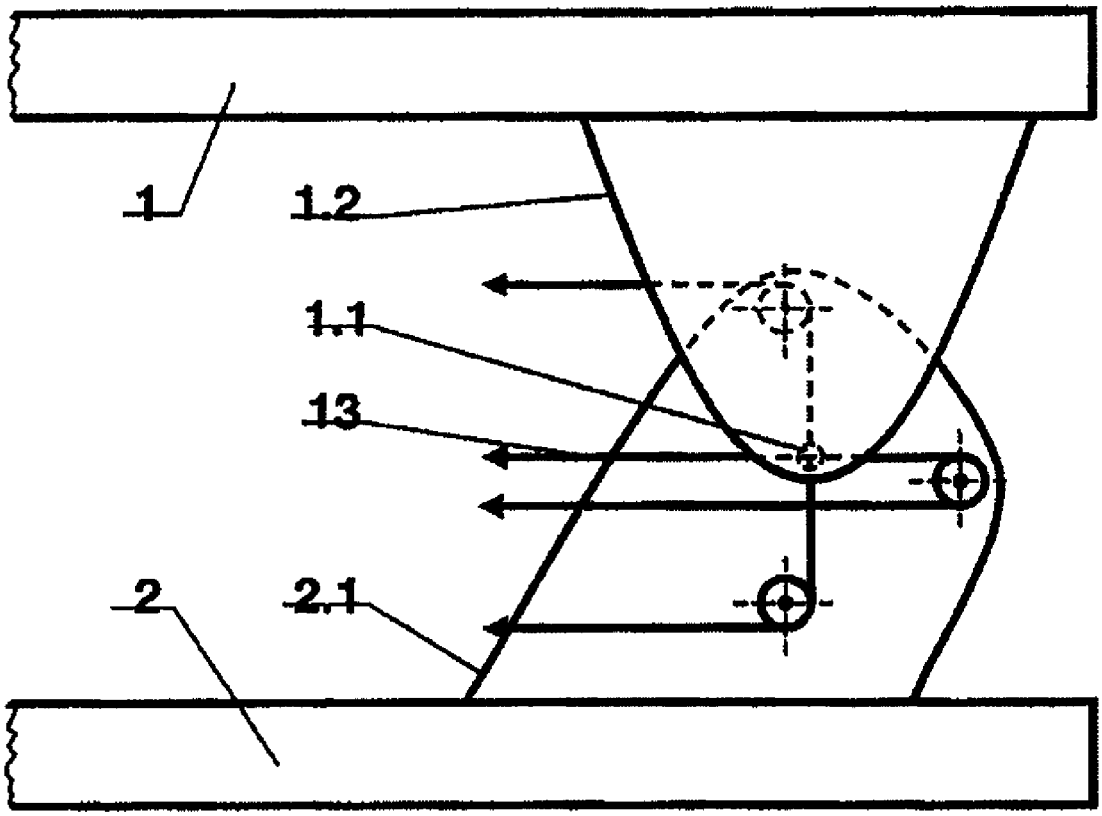
FIG. 3 shows a side view of important elements of a third device according to the invention, in which, once again, only pulling piston-free pneumatic actuators are used as active, controllable, length-adaptable adjusting elements. The force transmission from the piston-free pneumatic actuators to the mobile surface is effected here once again by means of cables and guide rollers. Compared to the device in FIG. 2, the mobile surface can be moved in further degrees of freedom.

In the construction according to FIG. 3, the device from FIG. 2 is extended by a horizontally oriented cable at the force application point 1.1 for the mobile surface 1, with pulling piston-free pneumatic actuators again being arranged at both ends. In this way, linear movements in the horizontal direction are also possible.

According to FIG. 3, the mobile surface 1 is arranged above the uppermost guide roller. The application point 1.1 for the forces exerted by the cables 13 on the mobile surface 1 is fixed on a part 1.2 protruding rigidly downward from the latter. Consequently, the mobile surface 1 lies relatively high in relation to the base 2, but does not need to have any other parts of the device protruding above it.

Figure 4:
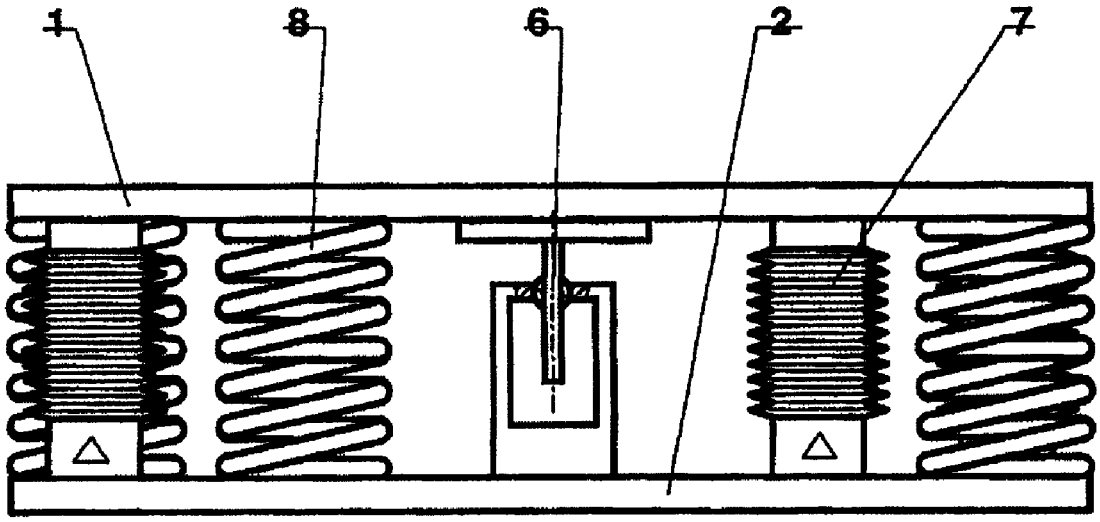
FIG. 4 shows a side view of a structurally very simple fourth device according to the invention. Pushing piston-free pneumatic actuators are used as active, controllable, length-adaptable adjusting elements. Pulling, pretensioned elastic springs work in the opposite direction.

According to the construction in FIG. 4, pushing piston-free pneumatic actuators 7 and pulling elastic springs 8, which are ideally pretensioned slightly, are arranged in an alternating sequence between the periphery of the mobile surface 1 and the base 2. A guide mechanism 6 can optionally be provided to prevent movement of the mobile surface 1 parallel to the base 2. The abutment for the lowest possible setting of the mobile surface 1 can also be formed on this guide mechanism 6. This construction is very simple and can also be made very low. However, compared to a construction in which the elastic springs 8 are replaced by controllable, pulling piston-free pneumatic actuators, the pushing piston-free pneumatic actuators 7 have to be made slightly stronger, since they not only have to lift the load located on the mobile surface, but additionally have to overcome tensile force of the springs 8. If one can manage with slightly restricted dynamics, the pulling, elastic springs 8 can also be simply omitted.

In a very simple and elegant construction, three pushing piston-free pneumatic actuators, positioned relative to one another at the corners of an imaginary triangle, for example an equilateral triangle, are arranged between the base and the mobile surface arranged at a distance above the latter. A rubber cable extends in a zigzag of many runs at the periphery between the base and the mobile surface and, in addition to the weight of the load located on the mobile surface, draws them toward each other.

A large number of other constructions using piston-free pneumatic actuators are also conceivable and useful. For example, swiveling movements about a vertical axis can be permitted if the base is designed in two parts, with an upper part mounted rotatably on the lower part about a vertical axis.

Since piston-free pneumatic actuators and also elastic springs have no parts rubbing against each other during their movement, in particular no sliding sealing surface, and therefore have no static friction, it is also possible for short, gentle movements without jolting to be performed despite the elasticity of volume of the driving pressure medium, namely air.

On account of the volume elasticity of gases, the use of piston-free pneumatic actuators as drive elements means greater restriction in the controllability of movement profiles than for example when using hydraulic cylinders. These restrictions apply especially to the speed with which a nominal state of the length of the actuators is reached. In the described application purposes for moving people, these restrictions do not play any role, since the temporary inaccuracies can be kept within ranges of such short duration and of such small length measurements that it is not disruptive to persons, and sometimes cannot even be felt at all.

In order especially to optimally adjust the transient response of the control loop to the movement profiles, it is useful for control parameters, such as intensification or attenuation constants, to be adapted to the mass that is located on the mobile surface. The required determination of the mass can take place at the running time, without the need for additional sensors, since the measurement of the length of the piston-free pneumatic actuators and the measurement of the pressure prevailing in them can be used to draw conclusions concerning the force bearing on them and, consequently, the weight pushing on the mobile surface.

For mechanical working, the piston-free pneumatic actuators are supplied with compressed air by a compressor (not shown here). For relaxation, the air is simply let out. The exact control of a piston-free pneumatic actuator is effected via the controllable valve 3.1. The compressor is ideally extended by a small storage volume for compressed air, since it can then be configured for a problem-free low output. The compressor too can thus be transported by one person. Only the normal domestic mains voltage is needed to operate it.

Figure 5:
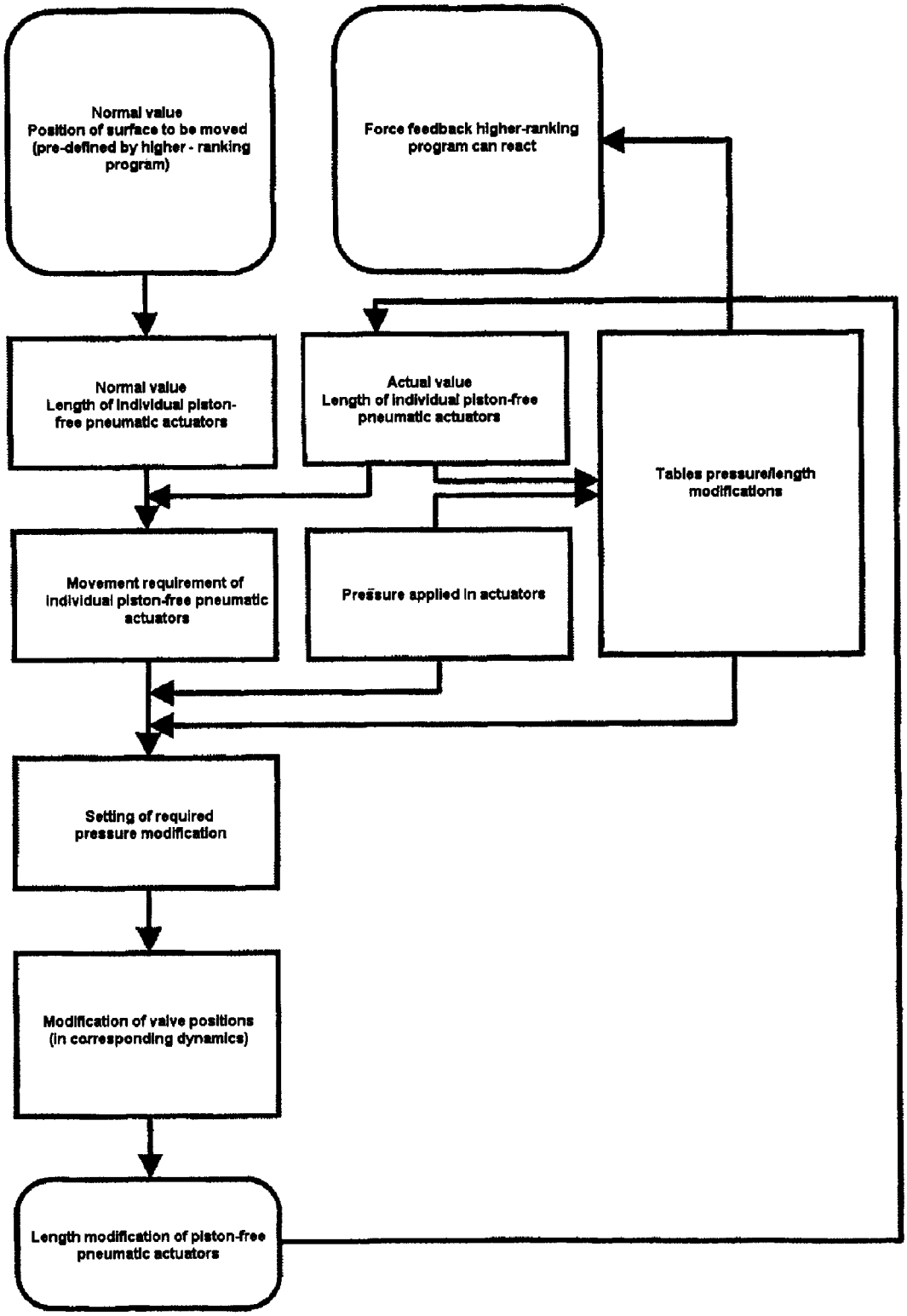
FIG. 5 shows a possible sequence of the information processing involved in adapting the actual position of the mobile surface to a nominal position. The individual fields show interim results of the information processing. The lines with arrow heads signify the acquisition of data from sensors, or calculation procedures.

FIG. 5 shows a possible sequence of the information processing when adapting the actual setting of the mobile surface to a nominal setting. Upon a controlled change of setting of the mobile surface 1, this sequence has to be run through several times a second, for example approximately 100 times. Most of this information processing relates, on the one hand, to the conversions between the position of the mobile surface and the lengths of the individual piston-free pneumatic actuators and, on the other hand, to the determination of the required pressure changes in the individual piston-free pneumatic actuators for desired changes in length. The hardware necessary for this, that is to say sensors and data processing units, are readily obtainable with the required level of performance. For each construction of the devices according to the invention, expenditure on programming is needed only once, in order to ensure the correct sequence.

The nominal value of the position of the mobile surface 1 can be predefined by a higher-ranking program, which is intended to determine the character of the device felt by the user. For example, the following modes of behavior can be set by the higher-ranking program:

- cyclical linear movements (with adjustably changing frequencies and strokes)
- cyclical swiveling movements (with adjustably changing frequencies and strokes)
- imitation of the mobility of a panel that is resting on a roller
- imitation of the mobility of a panel that is resting on a ball
- imitation of the shaking felt in an earthquake
- imitation of the acceleration cycle felt by a rider on a horse
- imitation of the shuddering movements felt by a skier when descending across uneven ground
- imitation of the mobility of a board suspended on a number of ropes
- imitation of walking in mud and so on.

If only predefined movement profiles have to be run through, the higher-ranking program does not have to process any actual measurement results on the state of the devices. If simulations are intended to be experienced interactively, the higher-ranking program also has to process actual measurement results on the state of the device and include this in predefining the nominal values for the setting of the mobile surface. In this way it is also possible for the device to provide feedback on forces exerted by the person using it or the moved object. This can be of value in therapeutic applications, for example for improving the standing stability of patients otherwise at risk of falling, or in the testing of structural parts up to the load limit.

For simpler applications, instead of regulating the lengths of the individual piston-free pneumatic actuators, it may suffice to regulate only the pressure applied to them, or the mean pressure applied to a mutually pulling actuator pair.

The device according to the invention is eminently suitable for the, purposes of play, training and therapy. It can be made so simple, inexpensive, safe, light-weight and small that it is not only of advantage for commercial use, but can also be employed by a large number of private users in their own homes. Alternatively, it is so easy to transport that it can be used as a device for short-term lease.

It is recommended that the device according to the invention be used in connection with a computer which can also be used independently of it and on which the abovementioned higher-ranking program can run, and which on the associated screen also displays the matching images for the movement situations. With a suitable modular programming mode, it is thus easily possible, for different movement situations, to provide different program modules to be merged in and run separately.

It is advantageous to provide the mobile surface 1 with securing means for appliances or objects that are also intended to be moved. These appliances can be for example seats or holding frames that are intended to be moved together with a person. However, these can also be appliances or objects that are intended to be moved without persons on the device, for example for test purposes or for mixing of substances. The range of possible uses of the device according to the invention is thus extended, as a result of which the achievable sales figures in turn also increase, and the individual item prices can be lower. In applications which mainly involve vibrating accelerations, the lesser positional accuracy of the piston-free pneumatic actuators compared to other actuators is entirely sufficient.

The invention claimed is:

1. A device for actively moving people or objects in a flexible controllable manner, comprising:

a base surface;

a mobile surface on which the person to be moved or the object to be moved is located;

at least one frictionless actuator which acts between the base surface and the mobile surface;

at least one spring element coupling the base surface and the mobile surface, the at least one spring element being pre-tensioned such that a pre-tensioning force acts in opposition to a force generated by the at least one frictionless actuator so as to generate a restoring force; and a transmission, wherein the at least one frictionless actuator includes a pulling piston-free pneumatic actuator that lies with its longitudinal direction parallel to the base surface of the device, and wherein an action of a traction force of the pulling piston-free pneumatic actuator on the mobile surface is guided into the line of application using the transmission.

2. The device as claimed in claim 1, further comprising:

rigid parts that are movably guided, wherein the transmission is effected using the rigid parts.

3. The device as claimed in claim 1, further comprising:

flexible elements that transfer transaction forces, wherein the transmission is effected using the flexible elements.

4. The device as claimed in claim 3, wherein, from the base surface, an extension piece protrudes upward above the point of application of a cable on the mobile surface, and wherein a guide roller for the cable is arranged on the extension piece above the point of application.

5. The device as claimed in claim 4, wherein the mobile surface is arranged above the upper guide roller, wherein a rigid part protrudes downward from the mobile surface, and wherein a point of application of a cable lies on the rigid part.

6. A device for actively moving people or objects in a flexible controllable manner, comprising:

a base surface;

a mobile surface on which the person to be moved or the object to be moved is located;

at least one frictionless actuator which acts between the base surface and the mobile surface;

at least one spring element coupling the base surface and the mobile surface, the at least one spring element being pre-tensioned such that a pre-tensioning force acts in opposition to a force generated by the at least one frictionless actuator so as to generate a restoring force; and one or more guide mechanisms that act between the mobile surface and the base surface, wherein a horizontally acting traction movement of the at least one frictionless actuator is guided by the one or more guide mechanisms.

7. A device for actively moving people or objects in a flexible controllable manner, comprising:

a base surface;

a mobile surface on which the person to be moved or the object to be moved is located;

at least one frictionless actuator which acts between the base surface and the mobile surface;

at least one spring element coupling the base surface and the mobile surface, the at least one spring element being pre-tensioned such that a pre-tensioning force acts in opposition to a force generated by the at least one frictionless actuator so as to generate a restoring force, wherein the at least one frictionless actuator includes pulling or pushing piston-free pneumatic actuators that are active, controllable, mechanical adjusting bodies that move the mobile surface in one direction.

8. The device as claimed in claim 7, wherein the at least one frictionless actuator includes a pushing piston-free pneumatic that lifts the mobile surface, and wherein the at least one spring element includes a pulling elastic spring that lowers the mobile surface.

9. The device as claimed in claim 8, wherein the at least one frictionless actuator includes three pushing piston-free pneumatic actuators that are arranged relative to one another at the corners of an imaginary triangle, and wherein the at least one spring element includes a plurality of elastic tension springs that act between a periphery of the base surface and a periphery of the mobile surface.

10. The device as claimed in claim 9, wherein the plurality of the tension springs are formed by a continuous cable that is made of a rubber material.

11. A device for actively moving people or objects in a flexible controllable manner, comprising:

a base surface;

a mobile surface on which the person to be moved or the object to be moved is located;

at least one frictionless actuator which acts between the base surface and the mobile surface;

at least one spring element coupling the base surface and the mobile surface, the at least one spring element being pre-tensioned such that a pre-tensioning force acts in opposition to a force generated by the at least one frictionless actuator so as to generate a restoring force; and a controller that includes a control loop, wherein the control loop adjusts a length of the at least one frictionless actuator from a respective actual value to a nominal value, and wherein the nominal value is obtained by geometrical calculation from a setting of the mobile surface.

12. The device as claimed in claim 11, further comprising:

a program stored on a computer, wherein the program has a higher rank than the control loop, and wherein the program predefines the nominal value for the setting of the mobile surface.

13. The device as claimed in claim 11, wherein the device simulates a pattern of movement of the mobile surface according to at least one model.

14. The device as claimed in claim 12, wherein the computer storing the higher-ranking program operates independently of the movement device and that interacts with the movement device for the purposes of movement.

15. The device as claimed in claim 11, wherein the mobile surface further includes a securing device that secures other objects that are intended also to be moved by the surface.

16. The device as claimed in claim 12, wherein, from a way in which the load on the mobile surface reacts to a preset movement or change in force of the device, the higher-ranking program provides information regarding the nature of the load, and provides information that determines a further course of the program.

17. The device as claimed in claim 16, wherein breakage of an object arranged on the device is detected and is reacted upon.

18. The device as claimed in claim 16, wherein the higher ranking program provides information regarding a change in the posture of a person located on the device, and wherein the change in the posture is reacted to.

19. A device for actively moving people or objects in a flexible controllable manner, comprising:

a base surface;

a mobile surface on which the person to be moved or the object to be moved is located;

at least two oppositely acting frictionless actuators frictionless actuators which act between the base surface and the mobile surface; and at least one spring element coupling the base surface and the mobile surface, the at least one spring element being pre-tensioned such that a pre-tensioning force acts in opposition to a force generated by the at least two frictionless actuators so as to generate a restoring force, wherein the two frictionless actuators are piston-free pneumatic actuators, and wherein a length of the piston-free pneumatic actuators of the oppositely acting pair of actuators is calculated from the pressures prevailing in the oppositely acting pair of actuators.

20. A device for actively moving people or objects in a flexible controllable manner, comprising:

a base surface;

a mobile surface on which the person to be moved or the object to be moved is located;

at least one frictionless actuator which acts between the base surface and the mobile surface, wherein the at least one frictionless actuator includes a piston-free pneumatic actuator having a flexible tubular middle part and rigid end pieces; and at least one spring element coupling the base surface and the mobile surface, the at least one spring element being pre-tensioned such that a pre-tensioning force acts in opposition to a force generated by the at least one frictionless actuator so as to generate a restoring force.

21. A device for actively moving people or objects in a flexible controllable manner, comprising:

a base surface;

a mobile surface on which the person to be moved or the object to be moved is located;

at least one frictionless actuator which acts between the base surface and the mobile surface;

at least one spring element coupling the base surface and the mobile surface, the at least one spring element being pre-tensioned such that a pre-tensioning force acts in opposition to a force generated by the at least one frictionless actuator so as to generate a restoring force; and at least one sensor that measures a length of the at least one frictionless actuator and a pressure in the at least one frictionless actuator.

22. The device as claimed in claim 21, further comprising:

a controller that receives the measured length and the measured pressure from the sensor, wherein the controller includes a feed-back loop that regulates an actual length of the at least one frictionless actuator to match a desired length, the desired length being calculated from a desired position of the mobile surface.

23. The device as claimed in claim 22, wherein regulator parameters used by the controller are adjusted according to a mass disposed on the mobile surface.

24. The device as claimed in claim 23, wherein the controller performs a runtime determination of the mass using the measured length and the measured pressure and determines a force applied to the at least one frictionless actuator and a weight present on the mobile surface.

25. A device for actively moving people or objects in a flexible controllable manner, comprising:

a base surface;

a mobile surface on which the person to be moved or the object to be moved is located;

at least one frictionless actuator which acts between the base surface and the mobile surface;

at least one sensor that measures a length of the at least one frictionless actuator and a pressure in the at least one frictionless actuator; and a controller that receives the measured length and the measured pressure from the sensor, wherein the controller includes a feed-back loop that regulates an actual length of the at least one frictionless actuator to match a desired length, the desired length being calculated from a desired position of the mobile surface, wherein parameters used by the controller are adjusted according to a mass disposed on the mobile surface, and wherein the controller performs a runtime determination of the mass using the measured length and the measured pressure and determines a force applied to the at least one frictionless actuator and a weight present on the mobile surface.

26. The device as claimed in claim 25, wherein the at least one frictionless actuator includes a piston-free pneumatic actuator having a flexible tubular middle part and rigid end pieces.

* * * * *